US006868844B2

(12) United States Patent
Kawai

(10) Patent No.: US 6,868,844 B2
(45) Date of Patent: Mar. 22, 2005

(54) IGNITION COIL ASSEMBLY

(75) Inventor: Kazuhide Kawai, Kariya (JP)

(73) Assignee: Denso Corporation (JP)

( * ) Notice: Subject to any disclaimer, the term of this patent is extended or adjusted under 35 U.S.C. 154(b) by 15 days.

(21) Appl. No.: 10/435,468

(22) Filed: May 12, 2003

(65) Prior Publication Data

US 2003/0210119 A1 Nov. 13, 2003

(30) Foreign Application Priority Data

May 13, 2002 (JP) ..... 2002-136931

(51) Int. Cl.[7] ..... F02P 11/00
(52) U.S. Cl. ..... 123/635
(58) Field of Search ..... 123/634, 635; 336/90

(56) References Cited

U.S. PATENT DOCUMENTS 5,109,828 A * 5/1992 Tagami et al. ..... 123/635

FOREIGN PATENT DOCUMENTS

JP 9-250437 9/1997

* cited by examiner

*Primary Examiner*—Ramon M. Barrera
(74) *Attorney, Agent, or Firm*—Nixon & Vanderhye PC

(57) ABSTRACT

An ignition coil assembly includes a base member formed with collars having corrugated faces at the bottom ends thereof. Corresponding bosses are formed on the engine head cover, which also have corrugated faces conforming to those of the collars. When the base member is mounted on the engine, the ribs of one of the corrugated faces are fitted in the ridges of a corresponding corrugated face. When removing the ignition coil assembly from the engine, the relative positions of these corrugated faces are changed so that the ribs of one of the corrugated faces ride up onto the ribs of the other one, whereby the base member is lifted up.

12 Claims, 7 Drawing Sheets

IGNITION COIL ASSEMBLY

CROSS REFERENCE TO RELATED APPLICATIONS

This application is based upon, claims the benefit of priority of, and incorporates by reference, the contents of Japanese Patent Application No. 2002-136931 filed May 13, 2002.

BACKGROUND OF THE INVENTION

1. Field of the Invention

The present invention relates to an ignition coil assembly for a combustion engine of an automobile or the like, and more particularly to an ignition coil assembly which has a plurality of ignition coils connected to respective spark plugs mounted in plug holes in the engine.

2. Description of the Related Art

The prior art has shown an integrated connector block having a plurality of connectors for supplying power to ignition coils as disclosed, for example, in Japanese Patent Laid-Open Publication No. Hei 9-250437. According to the structure shown in this publication, a plurality of ignition coils are provided for corresponding spark plugs mounted in the engine. These are coaxially coupled to respective coil connecting portions on a lower face of a bar-like, resin connector block member so as to be outwardly fit onto the connecting portions.

Meanwhile, to enable the collective mounting of a plurality of ignition coils into their respective plug holes on the engine side, there have been proposed ignition coil assemblies that each hold a plurality of ignition coils fixedly arranged with a predetermined spacing. FIG. 10 shows one such prior art ignition coil assembly 51. A resin base member 53 supports a plurality of ignition coils 52 at locations corresponding to their respective plug holes 5*d* formed in the engine head cover 5. Each ignition coil 52 is fastened to the base member 53 by bolts or is integrally formed therewith by a resin molding process. The ignition coil assembly 51 is mounted on the engine head cover 5 so that the ignition coils 52 are coaxially inserted into the plug holes 5*d*. The ignition coil assembly 51 is then fixed to the engine by mounting bolts 53*c* screwed through bolt holes at lengthwise ends of the base member 53.

The problem with such a prior-art ignition coil assembly 51 is that it involves the cumbersome work of pulling out all the ignition coils 52 together from the plug holes in the engine for the service and replacement of the spark plugs—as illustrated in FIG. 11. The ignition coils 52 are respectively connected to the spark plugs 6 by plug caps 52*d*. Pulling out all the ignition coils 52 at once requires a large force that is represented by the strength required for pulling out one ignition coil multiplied by the number of engine cylinders. Thus the dismounting of the ignition coils 52 is hard work, and is sometimes simply impossible.

SUMMARY OF THE INVENTION

In light of the above drawbacks, an object of the present invention is to provide an ignition coil assembly with a base member including a removal mechanism that permits easy separation of the assembly from the engine.

To achieve the above object, a first aspect of the present invention provides an ignition coil assembly. The ignition coil assembly includes a plurality of ignition coils connected to respective spark plugs mounted in respective plug holes formed in the engine, a base member detachably mounted to the engine for supporting the plurality of ignition coils at locations corresponding to the plug holes in the engine, and a removal mechanism for allowing the base member mounted to the engine to be removed from the engine.

Thus the base member mounted on the engine is separated from the engine by the removal mechanism against the joint strength between the spark plugs in the plug holes of the engine and the plug caps at the bottom ends of the ignition coils. Therefore the ignition coil assembly can readily and reliably be removed for carrying out desired maintenance operations such as service and replacement of the spark plugs.

According to a second aspect of the invention, the removal mechanism includes an operation part that is manually operated and a pressing part that presses a portion of the engine when the operation part is moved in a predetermined direction. The base member is separated from the engine by a reaction force of a pressing force of the pressing part on the engine.

Moving the operation part in the predetermined direction causes the pressing part to press against the engine, and the reaction force of this pressing force reliably separates the base member from the engine. The ignition coil assembly is thus readily removable.

According to a third aspect of the present invention, the removal mechanism separates the base member from the engine such as to gradually increase a gap therebetween. Therefore the base member is gradually separated from the engine and eventually removed therefrom without the risk of being damaged by sudden, excessive forces.

According to a fourth aspect of the invention, the removal mechanism serves as a lock mechanism for fixing the base member to the engine when the base member is mounted thereon. With such a removal mechanism that can also serve as a lock mechanism, the base member can be fixed to the engine securely without utilizing fastening members such as bolts. According to a fifth aspect of the invention, the removal mechanism is constructed with a cam mechanism that separates the base member from the engine by displacement of cam members.

The cam mechanism creates a motion to separate the base member from the engine by the displacement of cam members. The base member is thus readily and reliably removable from the engine.

According to a sixth aspect of the invention, the cam mechanism may be, for example, a planar cam mechanism. The planar cam mechanism creates a motion to separate the base member from the engine by the displacement of planar cam members, whereby the base member is readily and reliably removable from the engine.

According to a seventh aspect of the invention, the cam mechanism may be configured such that the cam members can be rotated in a plane orthogonal to a direction in which the base member is removed. In that case, the cam mechanism creates a motion to separate the base member from the engine by the displacement of cam members caused by the rotation in the orthogonal plane, and the base member is thereby readily and reliably removable from the engine.

Alternatively, according to an eighth aspect of the invention, the cam mechanism may be configured such that the cam members can be rotated in a plane parallel to a direction in which the base member is removed. In this case the cam mechanism creates a motion to separate the base member from the engine by the displacement of cam members that are caused by the rotation in the parallel plane, and the base member is thereby readily and reliably removable from the engine.

According to a ninth aspect of the invention, the removal mechanism includes corrugated faces having conforming ribs and ridges formed on the engine and on the base member to oppose each other. The corrugated faces are constructed such that their relative positions are changeable on a plane orthogonal to a direction in which the base member is removed. When the base member is mounted on the engine, the ribs of one of the corrugated faces fit in the ridges of the other one of the corrugated faces, and when the relative positions of the corrugated faces are changed, the ribs of one of the corrugated faces ride up onto the ribs of the other one of the corrugated faces, thereby separating the base member from the engine.

Thus, when the base member is mounted on the engine, the ribs of one of the corrugated faces fit in the ridges of the other one. When the relative positions of the corrugated faces are changed, the ribs of one of the corrugated faces ride up onto the ribs of the other one, thereby readily and reliably separating the base member from the engine.

According to a tenth aspect of the invention, the removal mechanism includes a lever that swivels around a fulcrum provided to the base member in a plane parallel to a direction in which the base member is removed. Manually turning one end of the lever swivels the same around the fulcrum provided to the base member on the parallel plane, whereby the other end thereof presses against the engine. The reaction force of this pressing force enables easy and reliable separation of the base member from the engine.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF PREFERRED EMBODIMENTS

The following description of the ignition coil assembly according to the present invention will be hereinafter described with reference to the accompanying drawings. The preferred embodiments are merely exemplary in nature and are in no way intended to limit the invention, its application, or uses.

The ignition coil assembly 1 according to a first embodiment is mounted to an automobile engine and includes a plurality of ignition coils consecutively arranged at a predetermined interval and coaxially connected to respective spark plugs mounted in the plug holes of the engine.

Figure 1:
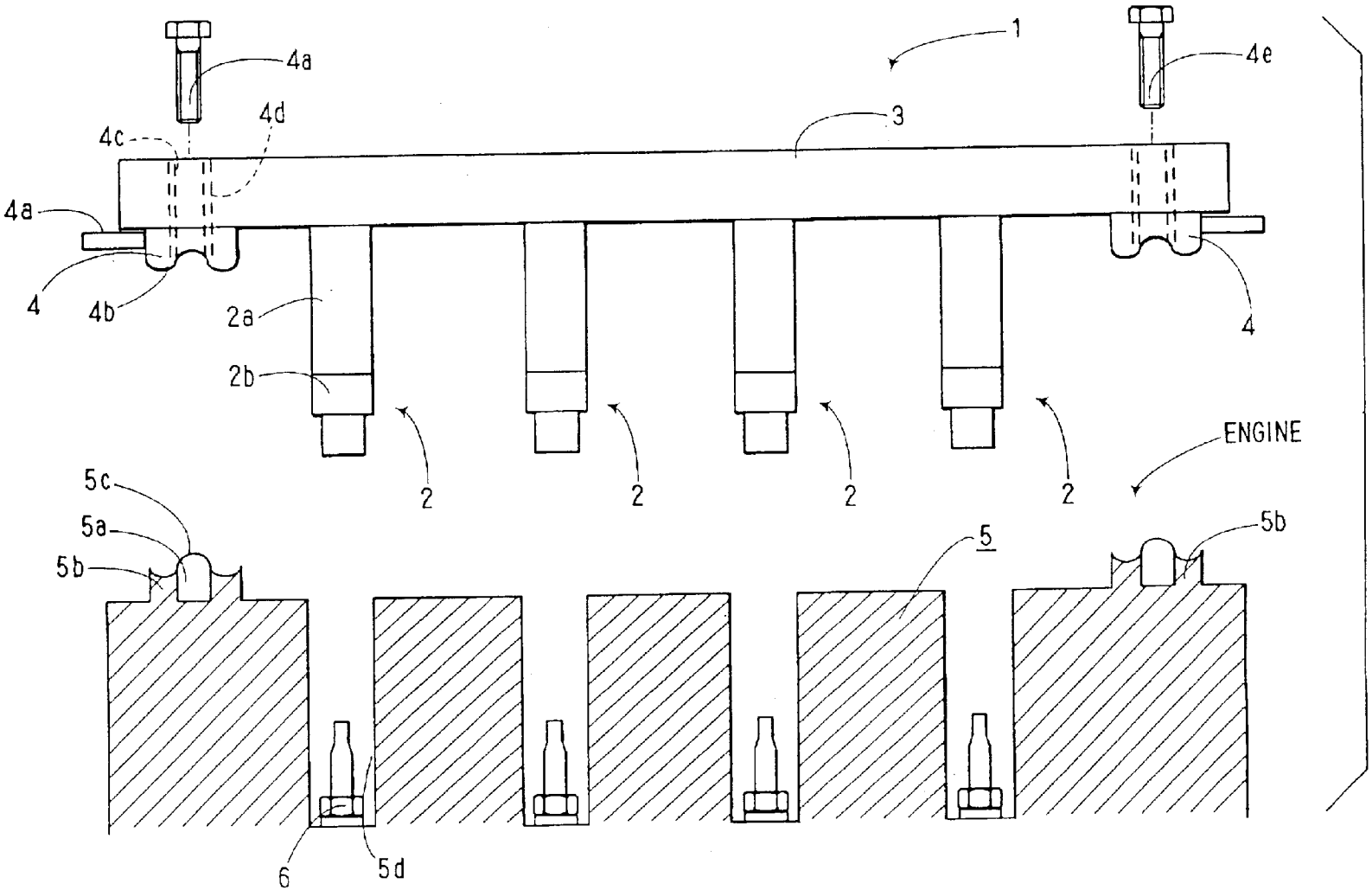
FIG. 1 is a side view of an ignition coil assembly according to a first embodiment of the present invention in a state in which it is removed from the engine.

As shown in FIG. 1, the upper ends of the plurality of ignition coils 2 are fixed by bolts (not shown) to a flat bar base member 3 having collars 4 at its lengthwise ends. The illustrated ignition coil assembly 1 of the present invention is designed for a four-cylinder engine, and thus has four ignition coils 2.

Each of the ignition coils 2 is a stick-like member comprising an insulating resin case and a built-in electric circuit for generating the high voltage supplied to the spark plug 6. Each ignition coil 2 is made up of a column-like body part 2*a*, and a tubular plug cap 2*b* at the lower end of the body part 2*a*, as shown in FIG. 1.

The body part 2*a* has a smaller diameter than the caliber of the plug holes 5*d* formed in the engine head cover 5, so that the coils 2 fit into the holes 5*d*. Note that "engine" or "engine side" can also mean the engine head cover 5 as discussed in this specification.

The plug cap 2*b* is a tubular member consisting of a resilient material such as rubber. When the ignition coils 2 are inserted into the plug holes 5*d*, the tops of the spark plugs 6 couple to the inner peripheral face of the plug caps 2*b* from below, thereby connecting the coils 2 with the plugs 6. The plug cap 2*b* and body part 2*a* make internal engagement with each other firmly enough so that the plug cap 2*b* does not readily come off of the body part 2*a* by an axial pulling force.

The base member 3 is a flat bar made of an insulating resin, or the like, and supports the plurality of ignition coils 2 at locations corresponding to the plug holes 5*d* on the engine side. The base member 3 is detachably mounted to the engine by mounting bolts 4*e*. The ignition coils 2 are provided in the same number as the plug holes, or engine cylinders, and with the same spacing as that of the plug holes 5*d* in the engine.

Figure 2:
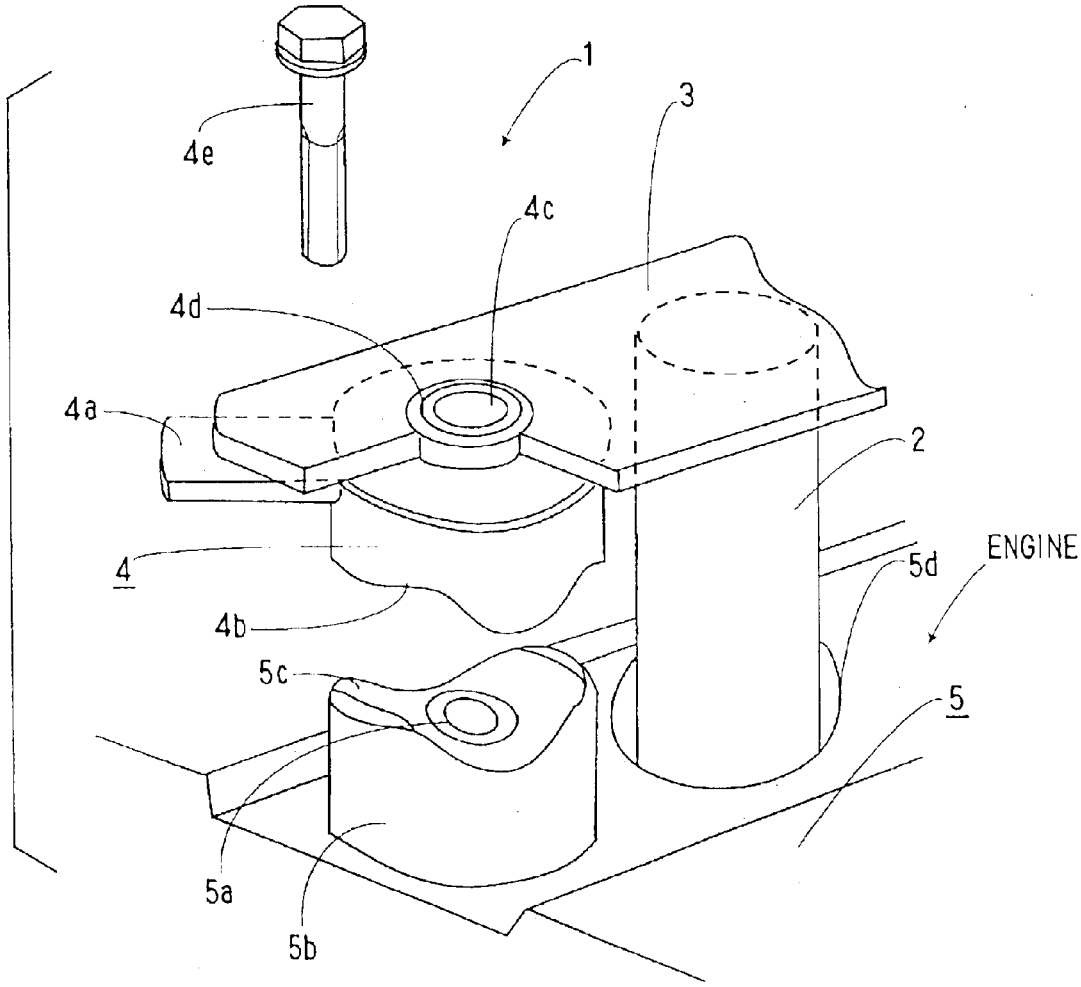
FIG. 2 is a perspective view of major parts of the ignition coil assembly with its base member partially cut away.
Figure 3:
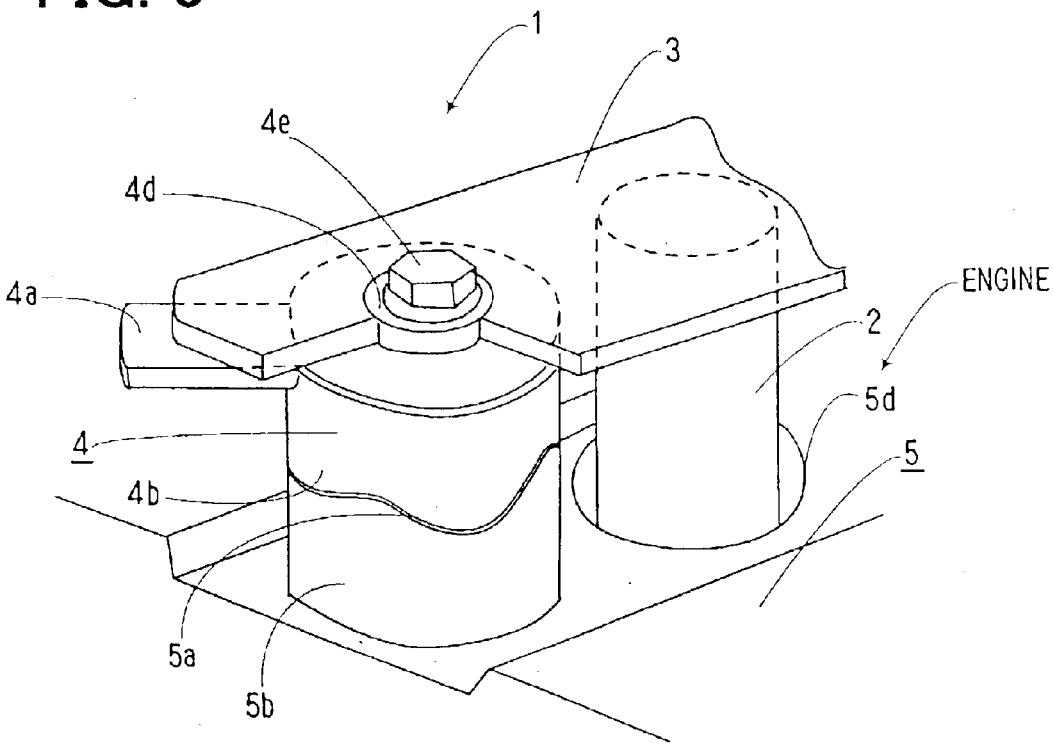
FIG. 3 is a perspective view of the ignition coil assembly of FIG. 2 mounted on the engine.

The base member 3 further includes internal wiring (not shown) embedded therein for electrical connection to the ignition coils 2. The collars 4 are column-like members made of resin and are provided at the lengthwise ends of the base member 3 as shown in FIG. 1 to FIG. 3. They are mounted around cylindrical rotational axes 4*d* parallel to the axes of the ignition coils 2, and rotatable in a plane orthogonal to the direction in which the base member 3 is removed. The collars 4 include levers 4*a* protruding to a side, which can be manually operated. The bottom ends of the collars 4 are formed as corrugated faces 4*b* that function as pressing parts. At the center of the rotational axis 4*d* of the collars 4, is formed a bolt hole 4*c* corresponding to the bolt hole 5*a* of the engine head cover 5. Thus the base member 3 is fixed to the engine by screwing the mounting bolts 4*e* into the bolt holes 4*c*, and the bolt holes 5*a* in the engine head cover 5.

The engine head cover 5 is a cover member made of an insulating resin material for covering the upper face of the engine, and is formed with the plurality of plug holes 5*d* into which the spark plugs 6 are mounted. At the lengthwise ends of the engine head, cover 5 are provided upwardly protruding column-like bosses 5*b* at locations corresponding to the collars 4 of the base member 3. The top ends of the bosses 5*b* are formed as corrugated fades 5*c* having ridges and ribs conforming to those of the corrugated faces 4*b* at the bottom ends of the collars 4. When the base member 3 is attached to the engine head cover 5, the ribs of one of the corrugated faces 4*b*, 5*c* fit into the ridges of the other, forming a continuous cylindrical surface as shown in FIG. 3.

Figure 5:
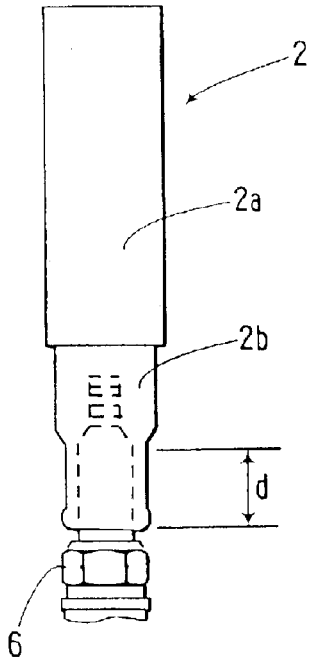
FIG. 5 is a diagram illustrating a plug cap and a spark plug coupled to each other.
Figure 4A:
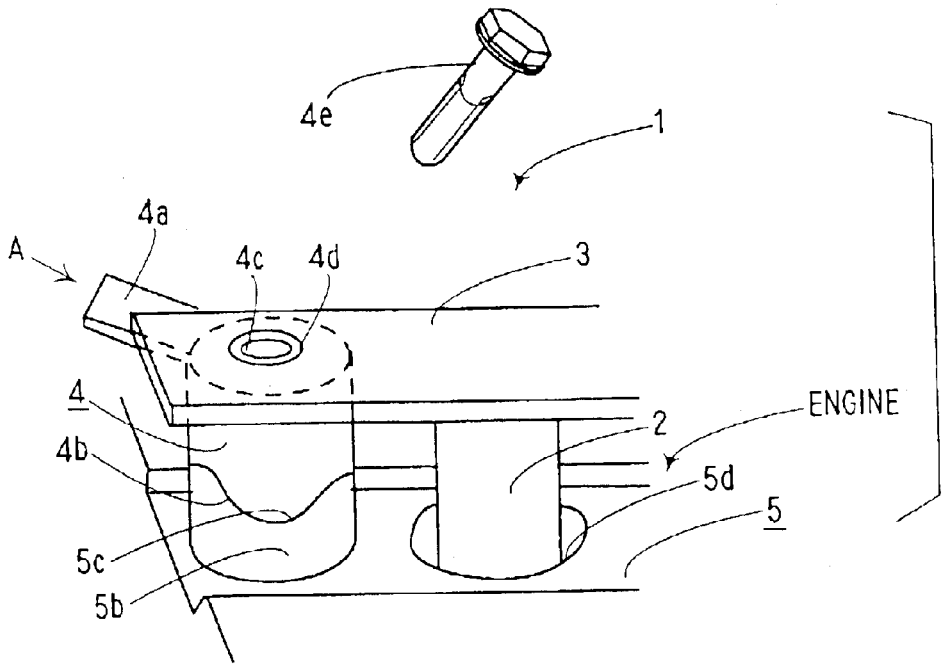
FIGS. 4A and 4B are perspective views illustrating how the base member is removed from the engine by turning a lever.
Figure 4B:
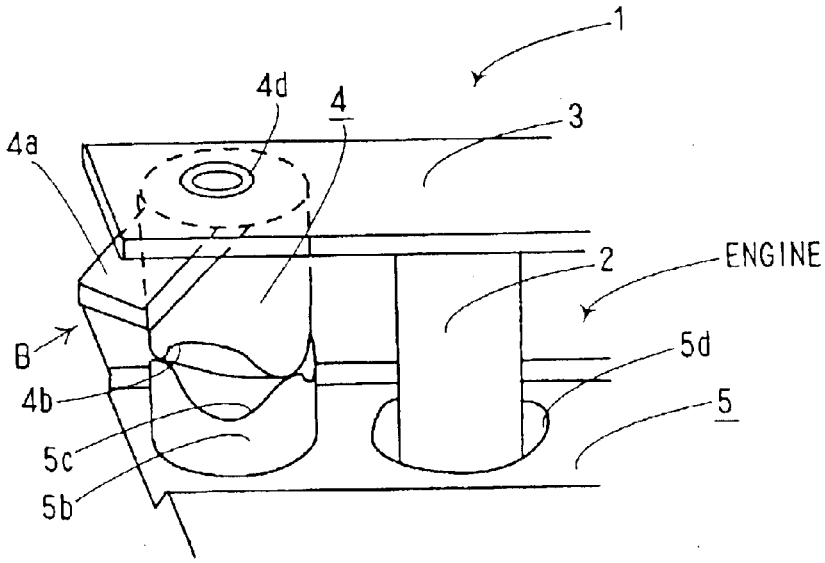

The base member 3 of the ignition coil assembly 1 that is attached to the engine head cover 5 can be removed therefrom as described below with reference to FIGS. 4A and 4B. When the ignition coil assembly 1 is mounted on the engine head cover 5, the lever 4*a* is located at a position indicated by arrow A in FIG. 4A. The bottom ends of the collars 4 and the top ends of the bosses 5*b* are in tight contact with each other, with the ribs and ridges of the corrugated faces 4*b*, 5*c* fitting against each other. Each of the ignition coils 2 is firmly connected to each spark plug 6, with the tops of the spark plugs 6 making engagement with the plug caps 2*b* at the bottom ends of the ignition coils 2 as shown in FIG. 5. The letter "d" in the drawing indicates the axial length with which the inner peripheral face of the plug cap 2*b* makes engagement with the outer peripheral face of the spark plug 6.

To remove the base member 3 thus assembled on the engine head cover 5, the mounting bolts 4*e*, which are screw-threaded at either lengthwise end of the base member 3, are loosened or removed. The lever 4*a* is then rotated manually on a horizontal plane toward the position indicated by arrow B. This changes the relative positions of the corrugated faces 4*b*, 5*c*, causing the ribs of one of the corrugated faces 4*b*, 5*c* to ride up onto the ribs of the other, thus lifting up the base member 3. In other words, as the ribs on the collar side press the ribs on the boss side, the reaction force from the pressing force creates an increasing gap between the base member 3 and the engine head cover 5. The reaction force eventually exceeds the joint strength between the tops of the spark plugs 6 and plug caps 2*b*, whereupon they are disengaged from each other as shown in FIG. 4B. To ensure this disengagement of the top of the spark plugs 6 from the plug caps 2*b*, the axial height of the ribs of the corrugated faces 4*b*, 5*c* is set larger than the length "d" indicated in FIG. 5.

The entire base member 3 is thus lifted up simply by turning the levers 4*a*, so that the ignition coil assembly 1 can be readily removed from the engine. Desired maintenance operations, such as the service and replacement of the spark plugs 6, can thereby be carried out smoothly. Since the gap between the base member 3 and the engine head cover 5 is increased in a gradual manner by the ribs of one of the corrugated faces 4*b*, 5*c* riding up onto the ribs of the other, no sudden or excessive force is applied to the base member 3, which could result in damage.

An ignition coil assembly 11 according to a second embodiment of the present invention will be described with reference to FIG. 6 and FIG. 7. This embodiment adopts a planar cam mechanism for the removal mechanism instead of the collars 4 and bosses 5*b* of the previous embodiment.

At either lengthwise end of the base member 3 is provided a lock mechanism 14. It bridges across the base member 3 and includes a pair of cam parts 14*b* serving as pressing parts pivoted around rotational axes 14*d* extending orthogonally to the length of the base member 3 to rotate on a plane parallel to the direction in which the base member 3 is removed. The lock mechanism 14 also includes a flat bar-like lever 14*a* coupling both cam parts 14*b* at one end thereof, and a pair of bosses 5*e* provided on the engine head cover 5.

Each cam part 14*b* consists of a planar cam member arranged parallel to the side face of the base member 3. The cam part 14*b* is formed with a cam groove 14*c* in the form of a circular arc slit around the rotational axis 14*d*, having an open end on the opposite side from the lever 14*a*. When the lever 14*a* is oriented horizontally in the position indicated by arrow C in FIG. 6, the cam groove 14*c* extends from a position directly below the rotation axis 14*d* by a particular distance toward the opposite side from the lever 14*a*. The outer face of each cam part 14*b* is positioned, with defined spacing, below the cam groove 14*c* and has a circular arc contour conforming to the cam groove 14*c*. The distance from the rotational axis 14*d* to the inner edge of the cam groove 14*c* is shortest at the portion directly below the rotational axis 14*d*, while the distance is the longest at the opposite end from the lever 14*a*. The groove 14*c* being formed such that the distance gradually increases from the lever end to the other end. The difference in the shortest and longest distances, from the rotational axis to the inner edge of the cam groove 14*c*, is set larger than the axial length of the fitting joint between the plug caps 2*b* and spark plugs 6 denoted by "d" in FIG. 5.

The bosses 5*e* on the engine head cover 5 are protruded in a widthwise direction from both sides of the base member 3 and are at locations corresponding to each of the cam grooves 14*c*, so that the bosses 5*e* will enter into the open ends of the cam grooves 14*c* on opposite sides of the lever 14*a*.

The base member 3 of the ignition coil assembly 11 that is attached on the engine head cover 5 can be removed therefrom as described below with reference to FIG. 6 and FIG. 7.

Figure 6:
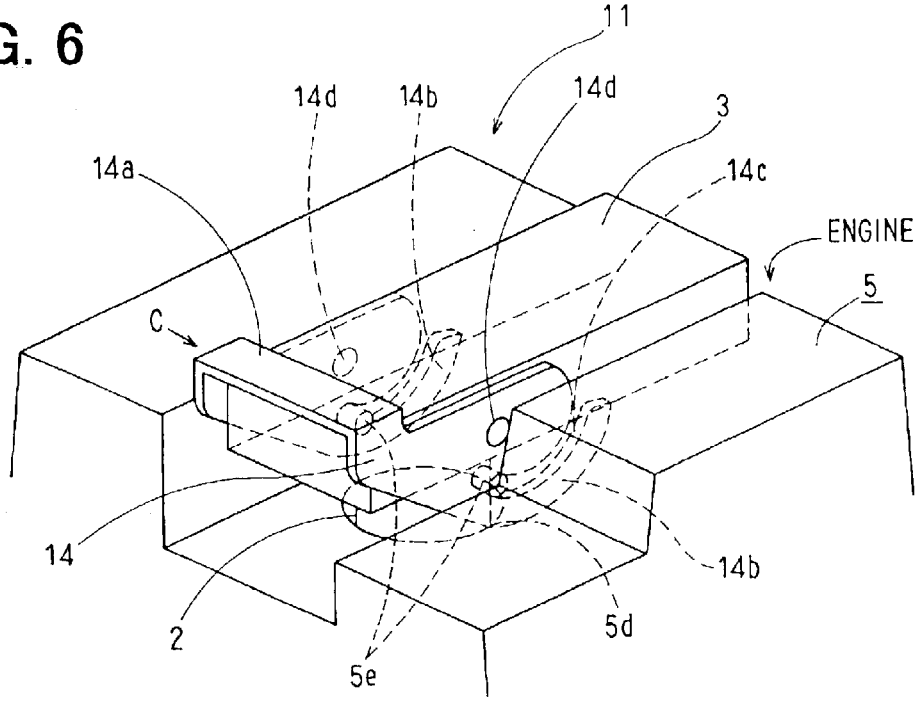
FIG. 6 is a perspective view illustrating major parts of an ignition coil assembly mounted on the engine according to a second embodiment, with the engine partially cut away.

When the ignition coil assembly 11 is mounted to the engine head cover 5, the lever 14*a* is located in the horizontal position as indicated by arrow C in FIG. 6, and each boss 5*e* is fitted in the innermost end of each cam groove 14*c*. This fitting engagement between each boss 5*e* and cam groove 14*c* fixes the base member 3 to the engine head cover 5. Each of the ignition coils 2 is firmly connected to each spark plug 6, with the tops of the spark plugs 6 engaging with the plug caps 2*b* at the bottom ends of the ignition coils 2.

Figure 7:
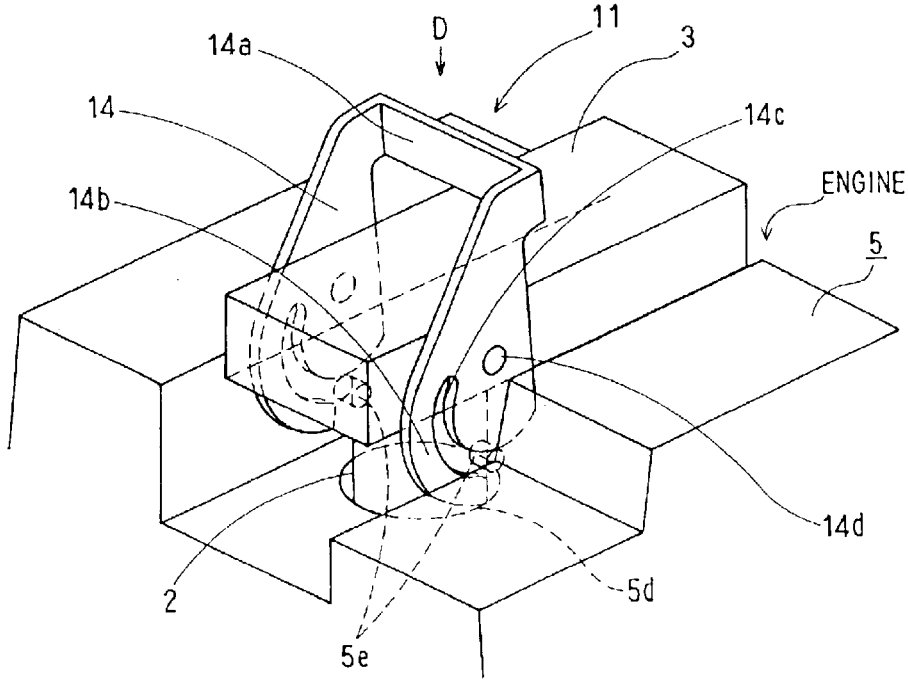
FIG. 7 is a perspective view illustrating how the base member of FIG. 6 is removed from the engine by turning a lever.

To remove the base member 3 thus assembled on the engine head cover 5, the lever 14*a* is manually rotated within the plane parallel to the direction in which the base member 3 is to be removed, and to a vertical position indicated by arrow D in FIG. 7 so as to move the cam parts 14*b*. As the lever 14*a* is raised, the circular arcuate outer faces of the cam parts 14*b* press the engine head cover 5. This is due to the sliding engagement between the bosses 5*e* and the inner edges of the circular arc cam grooves 14*c*, whose distance from the rotational axes 14*d* increases gradually towards the open ends. The reaction force to this pressing force lifts up the base member 3, until it eventually exceeds the joint strength between the tops of the spark plugs 6 and plug caps 2*b*, whereupon they are disengaged from each other. The entire ignition coil assembly 11 is thus lifted up simply by turning the levers 14*a*, so that the base member 3 is readily removed from the engine and a desired maintenance operation, such as the service and replacement of the spark plugs 6, can be carried out smoothly.

This embodiment has the advantage that it can omit the mounting bolts 4*e* used in the previous embodiment, as the lock mechanisms 14 serve as fastening means when the base member 3 is attached on the engine. It also allows for the easy locking and release of the base member 3 by a simple up and down operation of the levers 14*a*.

Next, an ignition coil assembly 21 according to a third embodiment of the present invention will be described with reference to FIG. 8 and FIG. 9. In this embodiment, the removal mechanism consists of a lever mechanism instead of the collars 4 and bosses 5*b*, or planar cam mechanism, of the first and second embodiments.

At either lengthwise end of the base member 3 is provided a lever mechanism 24, which is made up of a pair of bar-like pressing parts or levers 24*b* disposed on both sides of the base member 3 and pivoted around rotational axes 24*c* extending orthogonally to the length of the base member 3. There is also a lever 24*a* serving as an operation part that couples the pair of levers 24*b* at one end thereof. The levers 24*b* are straight from one end to the pivot or the rotational axis 24*c*, but are curved from there to the other end towards the engine side. The ratio of the length between the lever end and the pivot, to the length between the pivot to the curved end, should be large so as to achieve a large moment and mechanical advantage.

The base member 3 of the ignition coil assembly 21 that is attached on the-engine head cover 5 can be removed therefrom as described below with reference to FIG. 8 and FIG. 9.

Figure 8:
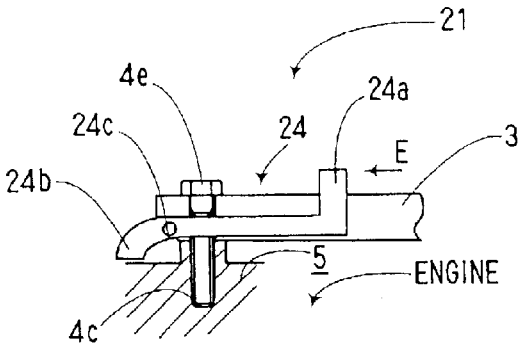
FIG. 8 is a side view illustrating major parts of an ignition coil assembly mounted on the engine according to a third embodiment of the present invention.
Figure 9:
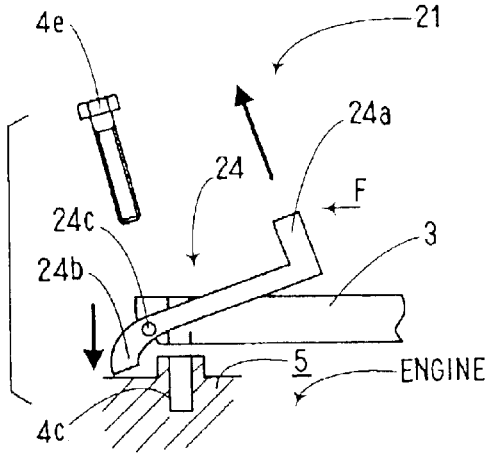
FIG. 9 is a diagram illustrating how the base member of FIG. 8 is removed from the engine by turning a lever.
Figure 10:
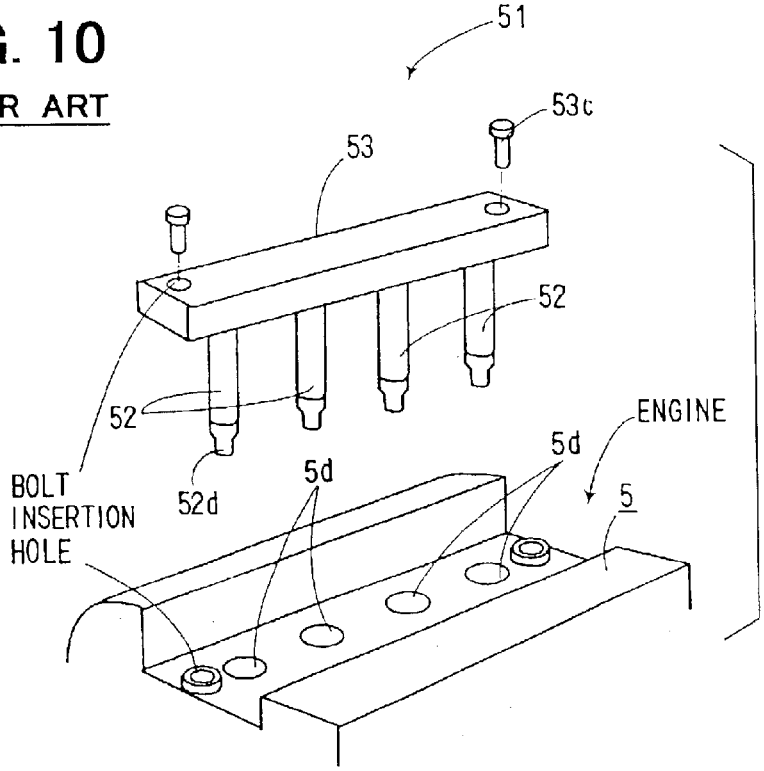
FIG. 10 PRIOR ART
FIG. 10 is a perspective view of one prior art ignition coil assembly.
Figure 11:
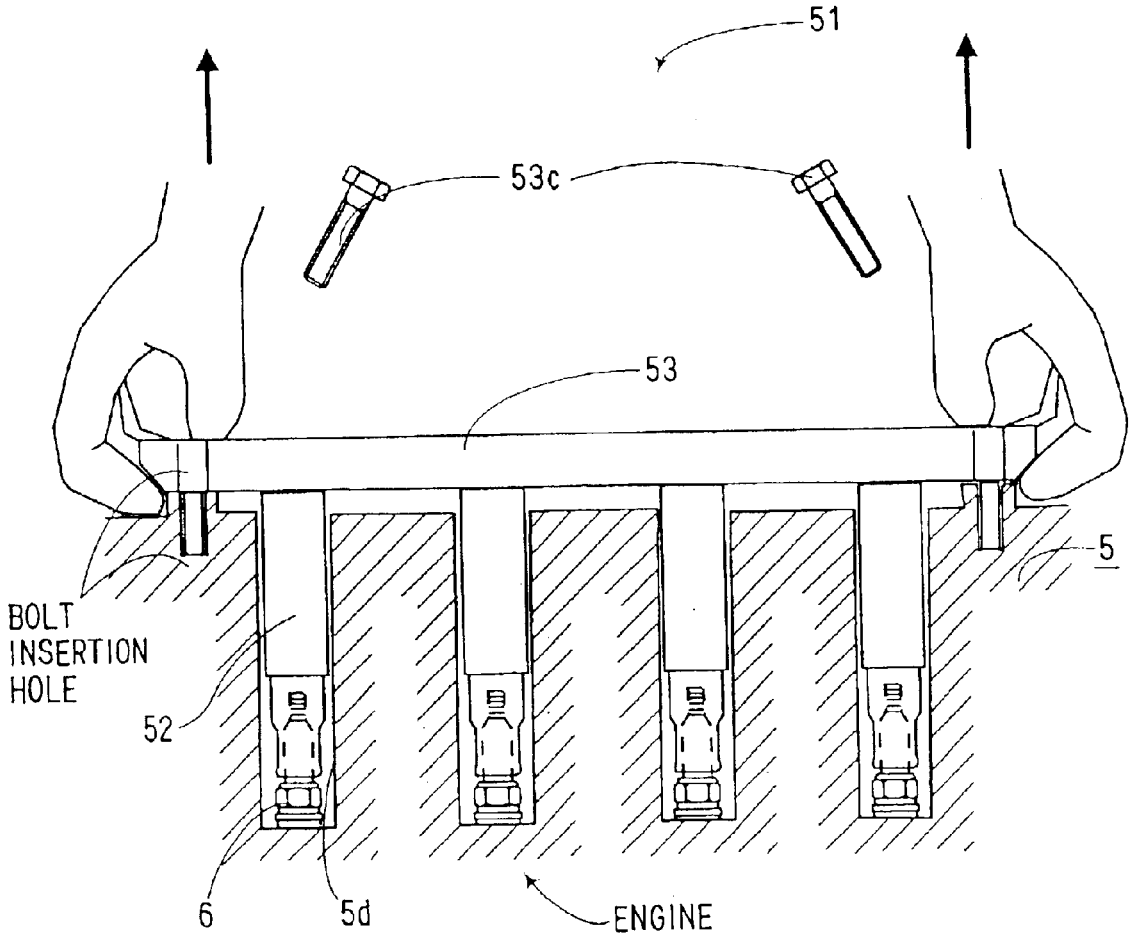
FIG. 11 PRIOR ART
FIG. 11 is a diagram illustrating how the prior art ignition coil assembly of FIG. 10 is removed from the engine.

When the ignition coil assembly 21 is mounted to the engine head cover 5, the lever 24*a* is located in the horizontal position indicated by arrow E in FIG. 8. Each of the ignition coils 2 is firmly connected to each spark plug 6, with the tops of the spark plugs 6 engaging the plug caps 2*b* at the bottom ends of the ignition coils 2.

To remove the base member 3 thus assembled on the engine head cover 5, the mounting bolts 4*e*, which are screw-threaded at either lengthwise end of the base member 3, are loosened or removed. The levers 24*a* are then swiveled manually upward to the position indicated by arrow F in FIG. 9. This causes the other ends of the levers 24*b* to swivel downwards around the rotational axes 24*c* serving as the fulcrum to abut and press against the engine head cover 5. The reaction force to this pressing force lifts up the base member 3 gradually, until it exceeds the joint strength between the tops of the spark plugs 6 and plug caps 2*b*, whereupon they are disengaged from each other.

The entire ignition coil assembly 21 is thus lifted simply by turning the levers 24*a* so that it is readily removed from the engine, and a desired maintenance operation, such as the service and replacement of the spark plugs 6, can be carried out smoothly.

The present invention should not be limited to the above described embodiments, and various changes and modifications may be made therein without departing from the scope of the invention. For example, while the second embodiment employs a removal mechanism that consists of a planar cam mechanism, it can adopt various other cam mechanisms. Further, although the cam mechanism in the illustrated embodiment is constructed such that the cams are rotated within the plane parallel to the direction in which the base member is removed, it may of course be arranged so that the cams are rotated in an orthogonal plane.

The structure adopted in the second embodiment, in which the base member is locked when mounted on the engine, may also be incorporated into the first or the third embodiment, so that part of the collars 4 (first embodiment) or levers 24 (third embodiment) engage with part of the engine so as to serve as a lock mechanism.

Various structures and mechanisms other than the examples given in the above-described embodiments can be employed as a removal mechanism. As described above, the ignition coil assembly according to the present invention includes a removal mechanism that allows for the easy separation of the base member from the engine, despite the joint strength between the spark plugs in the plug holes of the engine and the plug caps at the bottom ends of the ignition coils. The ignition coil assembly thus lends itself to be readily and reliably removed to facilitate a desired maintenance operation such as the service and replacement of the spark plugs.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. An ignition coil assembly mounted in an engine, comprising:

a plurality of ignition coils connected to respective spark plugs mounted in respective plug holes formed in the engine;

a base member detachably mounted to said engine for supporting said plurality of ignition coils at locations corresponding to said plug holes in said engine; and a removal mechanism for allowing said base member mounted to said engine to be removed from said engine, wherein said removal mechanism includes:

an operation part that is manually operated; and a pressing part that presses a portion of said engine when said operation part is moved in a predetermined direction, wherein said base member is separated from said engine by a reaction force of a pressing force of said pressing part on said engine.

2. The ignition coil assembly according to claim 1, wherein said removal mechanism separates said base member from said engine such as to gradually increase a gap therebetween.

3. The ignition coil assembly according to claim 2, wherein said removal mechanism also serves as a lock mechanism for fixing said base member to said engine when said base member is mounted thereon.

4. The ignition coil assembly according to claim 3, wherein said removal mechanism is constructed with a cam mechanism that separates said base member from said engine by displacement of cam members.

5. The ignition coil assembly according to claim 2, wherein said removal mechanism is constructed with a cam mechanism that separates said base member from said engine by displacement of cam members.

6. The ignition coil assembly according to claim 1, wherein said removal mechanism also serves as a lock mechanism for fixing said base member to said engine when said base member is mounted thereon.

7. The ignition coil assembly according to claim 1, wherein said removal mechanism is constructed with a cam mechanism that separates said base member from said engine by displacement of cam members.

8. The ignition coil assembly according to claim 7, wherein said cam mechanism is a planar cam mechanism.

9. The ignition coil assembly according to claim 8, wherein said cam mechanism is configured such that the cam members are rotated in a plane paralled to a direction in which said base member is removed.

10. The ignition coil assembly according to claim 7, wherein said cam mechanism is configured such that the cam members are rotated in a plane orthogonal to a direction in which said base member is removed.

11. The ignition coil assembly according to claim 1, said removal mechanism further including:

a plurality of corrugated faces having conforming ribs and ridges formed on said engine and on said base member that oppose each other, said corrugated faces being constructed such that their relative positions are changeable in a plane orthogonal to a direction in which the base member is removed, wherein when said base member is mounted on said engine, said ribs of one of the corrugated faces fit in said ridges of the other one of the corrugated faces, and when said relative positions of said corrugated faces are changed, said ribs of one of the corrugated faces ride up onto said ribs of the other one of the corrugated faces, thereby separating said base member from said engine.

12. An ignition coil assembly mounted in an engine, comprising:

a plurality of ignition coils connected to respective spark plugs mounted in respective plug holes formed in the engine;

a base member detachably mounted to said engine for supporting said plurality of ignition coils at locations corresponding to said plug holes in said engine; and a removal mechanism for allowing said base member mounted to said engine to be removed from said engine, wherein said removal mechanism also serves as a lock mechanism for fixing said base member to said engine when said base member is mounted thereon, said removal mechanism further including:

a lever that swivels around a fulcrum provided to said base member in a plane parallel to a direction in which said base member is removed.

* * * * *